US010711378B2

(12) United States Patent
Knudson et al.

(10) Patent No.: US 10,711,378 B2
(45) Date of Patent: Jul. 14, 2020

(54) KNIT TEXTILE SLEEVE WITH SELF-SUSTAINING EXPANDED AND CONTRACTED STATES AND METHOD OF CONSTRUCTION THEREOF

(71) Applicant: Federal-Mogul Powertrain, LLC, Southfield, MI (US)

(72) Inventors: Michael Knudson, Mohnton, PA (US); Tianqi Gao, Exton, PA (US); Zhong Huai Zhang, Pottstown, PA (US); Leigh Krauser, Pomeroy, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 290 days.

(21) Appl. No.: 15/648,336

(22) Filed: Jul. 12, 2017

(65) Prior Publication Data

US 2018/0016717 A1 Jan. 18, 2018

Related U.S. Application Data

(60) Provisional application No. 62/361,826, filed on Jul. 13, 2016.

(51) Int. Cl.

| | |
|---|---|
| ***D04B 21/14*** | (2006.01) |
| ***D04B 21/10*** | (2006.01) |
| ***D04B 21/20*** | (2006.01) |

(52) U.S. Cl.

CPC ..... *D04B 21/14* (2013.01); *D04B 21/10* (2013.01); *D04B 21/202* (2013.01); *D04B 21/205* (2013.01); *D10B 2401/046* (2013.01); *D10B 2505/12* (2013.01)

(58) Field of Classification Search

CPC ..... D04B 21/10; D04B 21/12; D04B 21/205; D04B 21/202; D04B 21/14

See application file for complete search history.

(56) References Cited

U.S. PATENT DOCUMENTS

| | | | | |
|---|---|---|---|---|
| 2,881,603 A * | 4/1959 | Vendetti | ..... | D04B 9/24 66/172 R |
| 3,511,062 A | 5/1970 | Nogues | | |
| 3,564,876 A | 2/1971 | Titone | | |

(Continued)

FOREIGN PATENT DOCUMENTS

WO 2016070033 A1 5/2016

OTHER PUBLICATIONS

International Search Report, dated Oct. 26, 2017 (PCT/US2017/041855).

*Primary Examiner* — Danny Worrell

(74) *Attorney, Agent, or Firm* — Robert L. Stearns; Dickinson Wright, PLLC

(57) ABSTRACT

A protective textile sleeve and method of construction thereof is provided. The sleeve has a knit, tubular wall extending lengthwise along a central longitudinal axis between opposite ends. The knit wall has a first state with a decreased length, increased cross-sectional area, as viewed in cross-section taken generally transversely to the central longitudinal axis, and a second state with an increased length, decreased cross-sectional area, as viewed in cross-section taken generally transversely to the central longitudinal axis. The wall includes knit, heat-set yarns imparting a bias on the wall, wherein the bias causes the wall to remain substantially in the first and second states absent an externally applied force.

18 Claims, 3 Drawing Sheets

(56) References Cited

U.S. PATENT DOCUMENTS

| | | | | |
|---|---|---|---|---|
| 4,781,039 | A * | 11/1988 | Ribarev | D04B 25/02 66/80 |
| 4,787,219 | A | 11/1988 | Sato et al. | |
| 5,505,117 | A * | 4/1996 | Dunlap | D04C 1/06 87/1 |
| 6,711,920 | B2 * | 3/2004 | Akers | F16L 57/04 66/170 |
| 7,690,225 | B2 * | 4/2010 | Relats | F16L 11/02 66/170 |
| 9,347,158 | B2 * | 5/2016 | Cabouillet | D04H 1/52 |
| 10,208,410 | B2 * | 2/2019 | Gao | D04C 1/08 |
| 2004/0176658 | A1 * | 9/2004 | McMurray | A61F 2/2481 66/193 |
| 2012/0328810 | A1 | 12/2012 | Relats Casas et al. | |
| 2014/0273699 | A1 * | 9/2014 | Zhang | D04B 21/14 66/170 |
| 2015/0176162 | A1 * | 6/2015 | Relats Manent | D04B 21/16 66/195 |
| 2015/0233029 | A1 * | 8/2015 | Woodruff | D04B 21/14 66/170 |
| 2016/0122915 | A1 | 5/2016 | Fathallah et al. | |
| 2016/0122916 | A1 * | 5/2016 | Fathallah | D04C 1/06 87/9 |
| 2017/0121868 | A1 * | 5/2017 | Zhang | D03D 3/02 |
| 2017/0121871 | A1 * | 5/2017 | Krauser | D04C 1/02 |
| 2018/0016717 | A1 * | 1/2018 | Knudson | D04B 21/14 |

* cited by examiner

KNIT TEXTILE SLEEVE WITH SELF-SUSTAINING EXPANDED AND CONTRACTED STATES AND METHOD OF CONSTRUCTION THEREOF

CROSS-REFERENCE TO RELATED APPLICATION

This application claims the benefit of U.S. Provisional Application Ser. No. 62/361,826, filed Jul. 13, 2016, which is incorporated herein by reference in its entirety.

BACKGROUND OF THE INVENTION

1. Technical Field

This invention relates generally to textile sleeves, and more particularly to knit textile sleeves.

2. Related Art

It is known to protect elongate members in textile sleeves against a variety of environmental conditions and affects, or to just contain elongate members in textile sleeves for bundling and routing purposes, such as in knit, woven or braided sleeves. It is further common to construct the sleeves having a circumferentially continuous, seamless wall, sometimes referred to as a 'closed' wall. Typically, upon disposing the sleeve about the elongate member to be protected, the wall of the sleeve is fixed to the elongate member via separate fasteners, such as tie wraps, adhesives, tape or the like. Although these types of fasteners can prove useful, they come with drawbacks. Some of the drawbacks include leaving adhesive residue on the elongate member being protected, coming undone while in use, at least in part, such as free ends of the tape becoming detached from the elongate member, appearing unsightly, being labor intensive during application, and requiring having the particular type of fastener on hand while installing the sleeve about the elongate member. These and other disadvantages make use of fasteners to fix a sleeve securely about an elongate member undesirable and costly.

A sleeve constructed in accordance with the invention overcomes at least those disadvantages discussed above, with others likely to become apparent to one skilled in the art upon viewing the description that follows.

SUMMARY OF THE INVENTION

In accordance with one aspect of the invention, a protective textile sleeve is provided having a knit, tubular wall extending lengthwise along a central longitudinal axis between opposite ends. The knit wall has a first state with a decreased length, increased cross-sectional area, as viewed in cross-section taken generally transversely to the central longitudinal axis, and a second state with an increased length, decreased cross-sectional area, as viewed in cross-section taken generally transversely to the central longitudinal axis. The wall includes knit, heat-set yarns imparting a bias on the wall, wherein the bias causes the wall to remain substantially in the first and second states absent some externally applied force.

In accordance with another aspect of the invention, the wall includes both heat-set yarns and non-heat-set yarns.

In accordance with another aspect of the invention, the wall includes warp knit stitches.

In accordance with another aspect of the invention, the wall can be fabricated entirely of heat-set yarns.

In accordance with another aspect of the invention, the wall can have single course lapped stitches.

In accordance with another aspect of the invention, the wall can have single course lapped stitches forming rhombus-shaped openings bounded by the knit yarns.

In accordance with another aspect of the invention, the wall can include multiple course lapped stitches forming hexagonal-shaped or honeycomb-shaped openings bounded by the knit stitches.

In accordance with another aspect of the invention, the wall can include pillar knit stitches.

In accordance with another aspect of the invention, a method of constructing a textile sleeve is provided. The method includes knitting a plurality of yarns with one another to form a seamless tubular wall extending lengthwise along a central longitudinal axis with at least some of the yarns being provided as heat-settable yarns. The method further includes heat-setting the heat-settable yarns while the wall is in one of a decreased length, increased cross-sectional area first state or an increased length, decreased cross-sectional area second state to impart a bias on the wall via the heat-set yarns, with the bias causing the wall to remain in each of the first and second states absent an externally applied axial force causing the wall to be moved to the other of the first or second state.

In accordance with another aspect of the invention, the method can include knitting the wall with a plurality of heat-settable yarns and a plurality of non-heat-settable yarns.

In accordance with another aspect of the invention, the method can include knitting the wall entirely with heat-settable yarns.

In accordance with another aspect of the invention, the method can include knitting the wall in a warp knitting process.

In accordance with another aspect of the invention, the method can include knitting the wall having single lapped stitches forming rhombus-shaped openings.

In accordance with another aspect of the invention, the method can include knitting the wall having multiple lapped stitches forming hexagonal-shaped openings.

In accordance with another aspect of the invention, the method can include knitting the wall having multiple lapped stitches forming honeycomb-shaped openings.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1A:
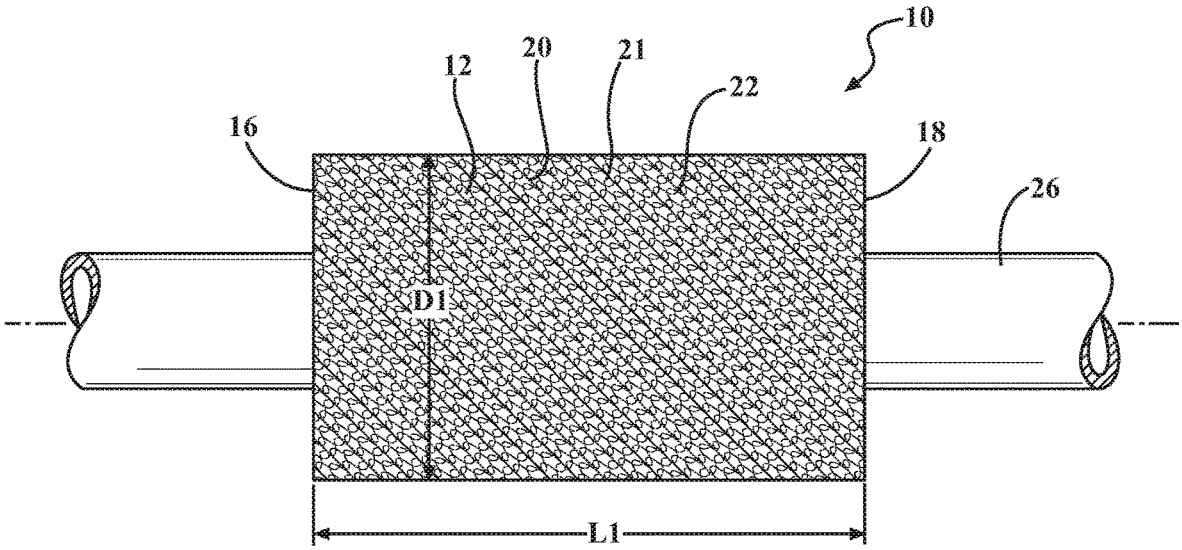
FIG. 1A is a schematic side view of a tubular knit sleeve constructed in accordance with one embodiment of the invention shown disposed about an elongate member to be protected while in its axially compressed, reduced length first state.
Figure 1B:
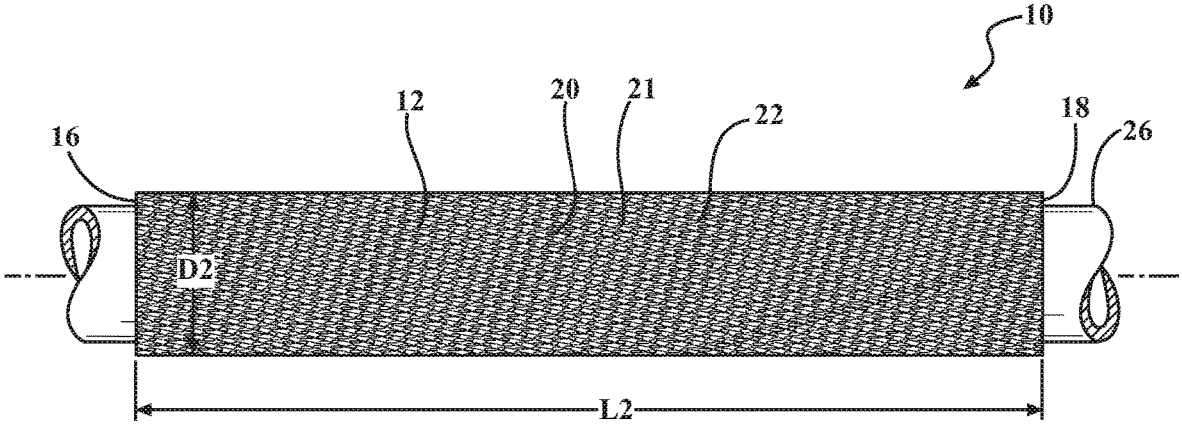
FIG. 1B is a view similar to FIG. 1A with the tubular knit sleeve shown in an axially extended, increased length second state about the elongate member.

Referring in more detail to the drawings, FIGS. 1A-1B illustrate a knit protective textile sleeve, referred to hereafter as sleeve 10, constructed in accordance with one aspect of the invention. The sleeve 10 has a knit, circumferentially continuous, seamless tubular wall 12 extending lengthwise about a longitudinal central axis 14 between opposite open ends 16, 18. The knit wall 12 is axially compressible to attain a pre-assembled first state, having a decreased length L1 and increased diameter D1 and/or increased cross-sectional area as viewed in lateral cross-section taken generally transversely to the central axis 14 (FIG. 1A) and is axially extendible to attain an assembled second state, having an increased length L2 and decreased diameter D2 and/or decreased cross-sectional area (FIG. 1B). The wall 12 includes at least some heat-settable, knit yarn 20, which upon being heat-set, causes at least a portion of the wall 12, in which the heat-set yarn 20 is knit, to remain in, or substantially in, a selected one of the first and second states absent some externally applied force, wherein the externally applied force can be selectively applied to overcome the bias, thereby axially contracting and extending the wall 12 between the first and second states, as desired. The heat-set yarn 20 imparts a bias on the wall 12, and upon overcoming the bias via the externally applied force, the wall 12 then remains in the newly selected state, whether the first or second state, until the wall 12 is further acted on by a suitable external force to again move the wall 12 to a different stable or substantially stable configuration, whereupon the wall 12 remains in the new stable configuration until acted on by a suitable external force. Accordingly, the wall 12 has bi-stable, self-sustaining axially compressed first and axially extended second states, though it should be recognized that the wall 12 is able to be readily manipulated to take-on multi-stable first and second state configurations as a result of being able to manipulate as many discrete regions along the length of the wall 12, between the opposite ends 16, 18, between the first and second states as desired.

Figure 2A:
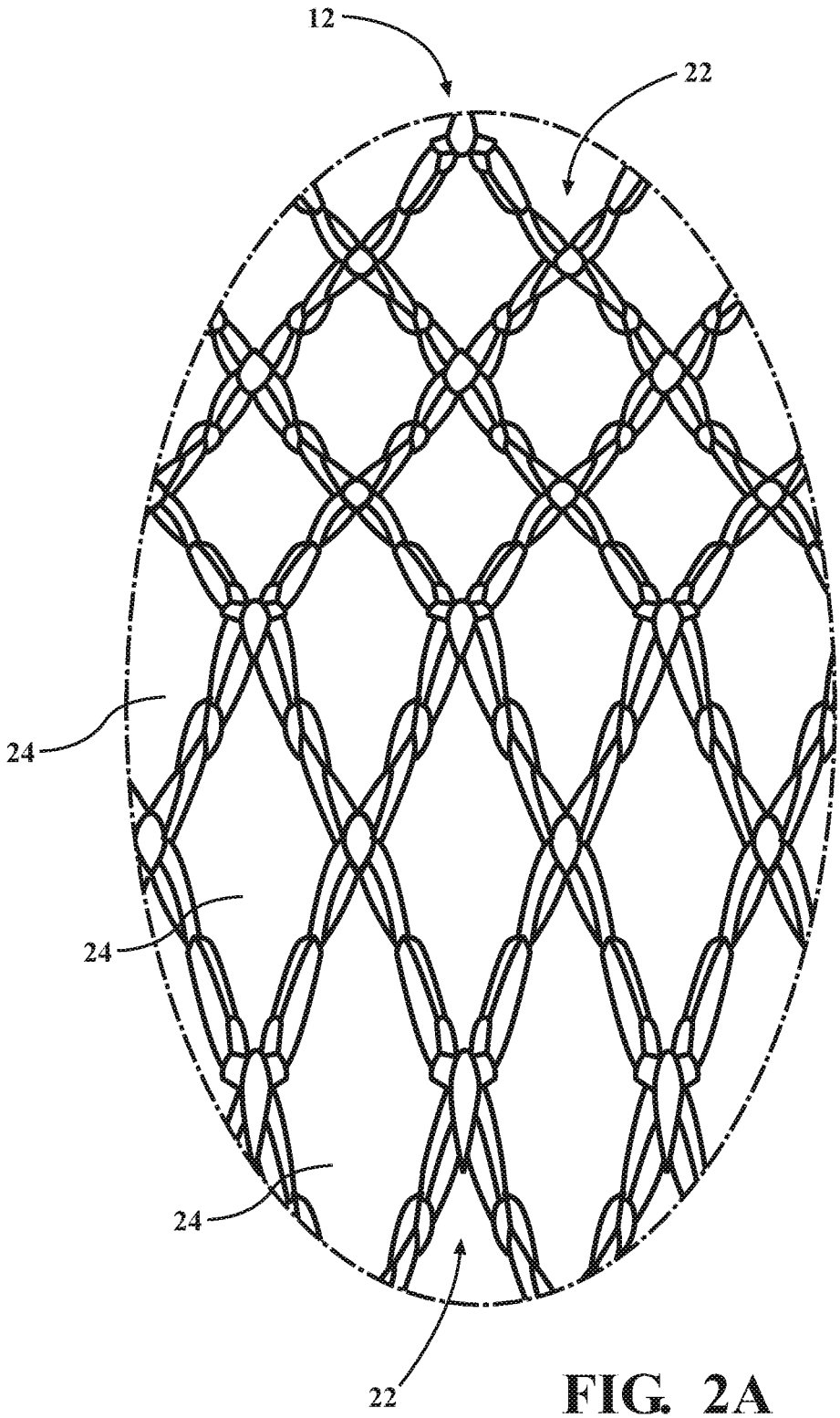
FIG. 2A is an enlarged fragmentary view of a wall of the sleeve of FIGS. 1A-1B constructed in accordance with one aspect of the invention.
Figure 2C:
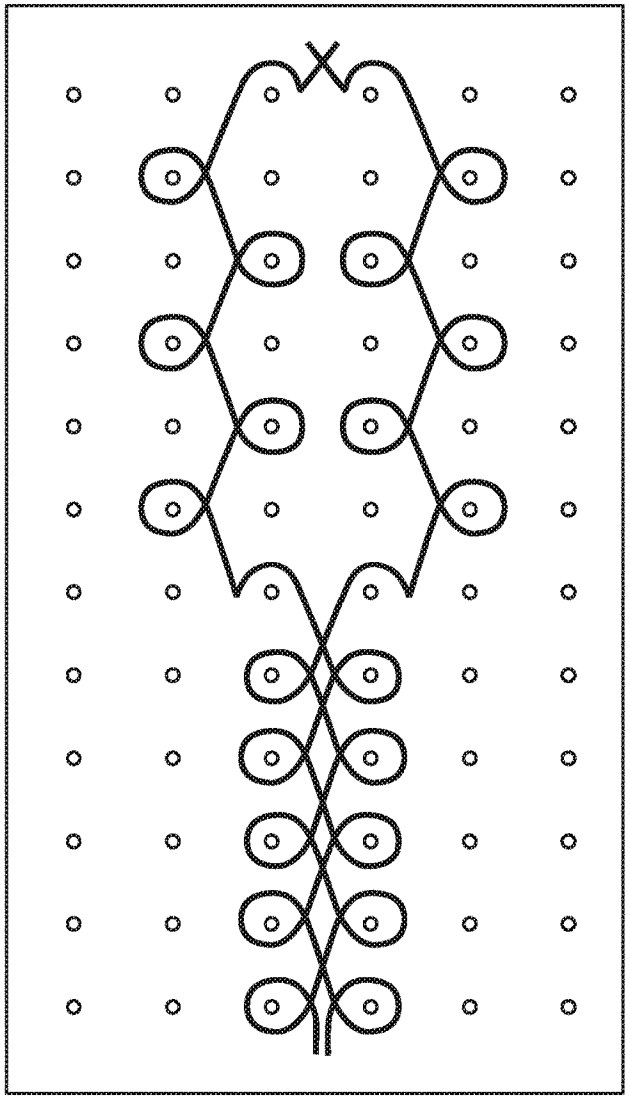
FIG. 2C is a knit stitch pattern illustrating the knit stitch of FIG. 2B.
Figure 2B:
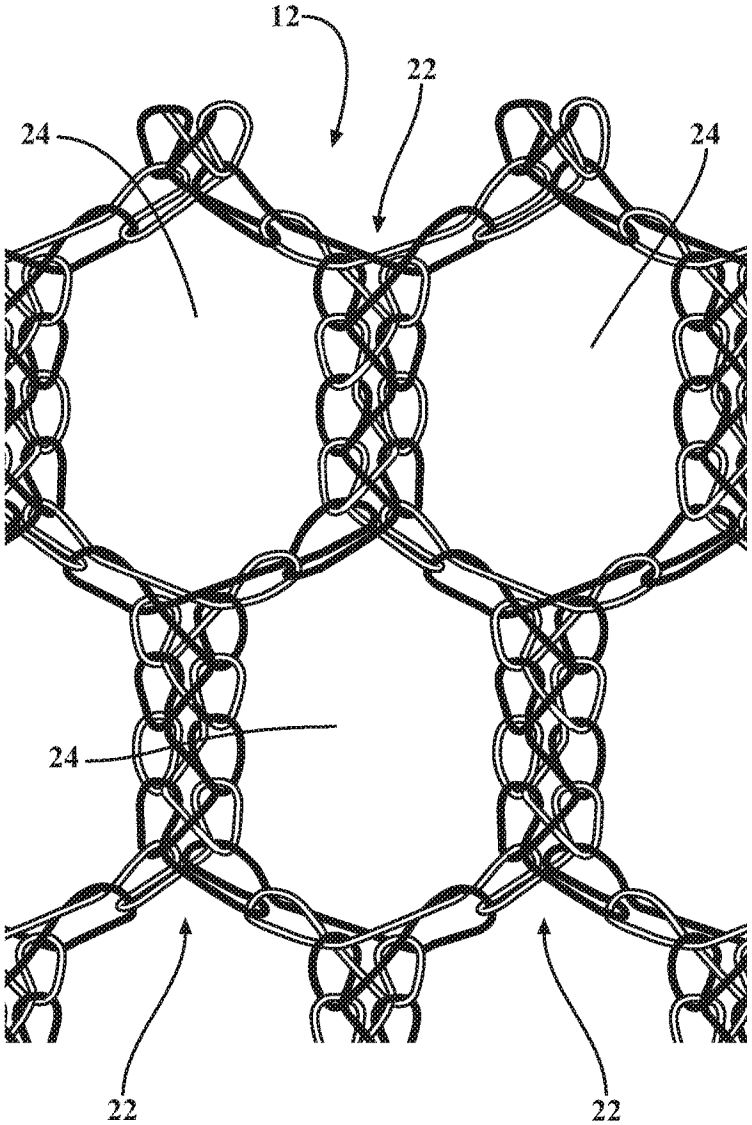
FIG. 2B is an enlarged fragmentary view of a wall of the sleeve of FIGS. 1A-1B constructed in accordance with another aspect of the invention.

The wall 12 is preferably warp knit on a warp knitting machine, though other knitting machines are contemplated herein. In accordance with one aspect of the invention, the wall 12 can be knit entirely of heat-settable yarns 20, and in accordance with another aspect of the invention, the wall 12 can be knit with both heat-settable yarns and non-heat-settable yarns 21. Regardless of which construction is employed, the yarns 20, 21, either individually as heat-settable yarns 20, or in combination with one another as heat-settable yarns 20 and non-heat-settable yarns 21, are interlinked with one another via knit stitches at interlinking looped locations 22. The interlinking of the loops 22 greatly enhances the effect of the bias imparted in the heat-set yarns 20 that causes biased movement of the wall 12 between the first and second bi-stable states and maintain the wall 12 or portion of the wall 12 in the selected state. The interlinked loops 22 can be knit via a variety of different knit stitch patterns, such as via single course interlinked loops 22, also referred to as lapping (FIG. 2A), or via sequential multiple course interlinked loops 22 (FIGS. 2B and 2C), wherein a plurality of sequential, adjacent courses, one after another, are interlinked along the lengthwise direction of the sleeve 10. Accordingly, the openings 24 bounded by the yarns 20, 21 can be generally rhombus-shaped (FIG. 2A) as a result of single lapped stitches, hexagonal-shaped (FIGS. 2B and 2C) as a result of multiple lapped stitches, or otherwise, such as honeycomb shaped as a result of multiple lapped stitches.

Upon knitting the wall 12, the heat-settable yarn 20, which can be provided as a heat-settable monofilament, heat-settable multifilament, heat-settable spun filament, and/or heat-settable flat tape yarn, such as from, for example, nylon, polyphenylene sulfide (PPS), polyethyleneterephthalate (PET), or polypropylene (PP), having a diameter between about 0.1-0.40 mm, by way of example and without limitation, or being generally flat, having a thickness between about 0.15-0.25 mm and a width between about 1.0-3.5 mm, by way of example and without limitation, is then heat-set while the wall 12 in a selected configuration, such as in a fully or at least partially axially compressed, reduced length state. For maximum bias, the entire wall 12 can be formed from a heat-settable yarn 20, though, if desired to provide additional types of protection other than abrasion, such as, enhanced coverage, thermal, acoustic or electromagnet interference (EMI), for example, at least some of the yarns can be provided as non-heat-settable yarn 21, such as a mineral fiber, e.g. basalt, silica, or ceramic or fiberglass, or as flexible conductive filaments, such as from wire, metal coated polymeric yarn filaments, or hybrid yarns including a conductive filament or non-conductive filament served or twisted with another yarn filament, such as a heat-settable or non-heat-settable monofilament and/or multifilament, for example.

Prior to heat-setting the heat-settable yarn 20, the opposite ends 16, 18 of the wall 12 are axially compressed toward one another until the wall 12 is brought to its radially expanded, increased diameter D1 and/or increased cross-sectional area (the area bounded by the wall 12 as viewed in lateral cross-section taken generally transversely to the central axis 14), reduced length L1, first state, and then a suitable degree of heat is applied to the heat-settable yarn 20, thereby causing the heat-settable yarn 20 to take on a heat-set. Upon being heat-set, the wall 12 attains a bias imparted by the heat-set yarn 20 that tends to maintain the wall 12 in the selected in-use second state configuration having an axially extended length L2, reduced diameter D2 and/or reduced cross-sectional area (FIG. 1B) or the in the pre-assembly first state configuration having an axially reduced length L1, radially expanded diameter D1 and/or increased cross-sectional area (FIG. 1A). Regardless of which state the sleeve 10 is in, the sleeve 10 remains in that state until a sufficient externally applied, axial force is applied to overcome the bias imparted by the heat-set yarn 20. When a suitable force is applied to the wall 12, generally along the direction central axis 14 of the sleeve 10, the portion or section of the wall 12 acted on by the axial force snaps, springs, causes the wall 12 to move from one state to the other, whereupon the wall 12 remains in the altered state until acted on again by a suitable external, axially applied force, whether going from the first state to the second state, or vice versa. As such, it should be recognized, the entire length of the wall 12 can be formed into one of the decreased length, first state or increased length, second state, or any number of discrete lengthwise extending portions or segments of the wall 12 can be manipulated to change between the aforementioned first and second states, as desired. Accordingly, axially extending segments of the wall 12 adjacent one another can be biased to remain in different ones of the first and second states from one another, if desired, thereby allowing the wall to take on a varying outer profile along its length.

Prior to the heat-setting step, the wall 12 of the sleeve, while being compressed axially to the reduced length L1, first state, the outer periphery of the wall 12 can be shaped to be other than circular. Accordingly, the outer periphery can be formed into a non-circular shape as viewed in lateral cross-section taken generally transversely to the central longitudinal axis 14. The non-circular shape can be any desired shaped as may be beneficial for the particular end-use application, such as square, rectangular, triangular, or any polygonal, non-circular shape. Then, upon forming the wall 12 into the reduced length L1, first state, and upon configuring the outer periphery of the wall 12 into the desired cross-sectional shape, the heat can be applied to the wall 12 to impart the heat-set into the heat-settable yarn 20, thereby providing the wall 12 with the bi-stable functionality, as well as forming the outer periphery into the selected shape, whether circular or non-circular, as viewed in lateral cross-section. It should be recognized the wall 12 can be axially compressed to the desired reduced length, whether fully compressed or partially compressed, and further, the wall 12 can be compressed is sections and heat set prior to cutting the sleeve to its finished length, or the wall 12 can be cut to length, then compressed to the desired length, and then heat-set. While compressing the wall 12, it is contemplated that the wall 12 can be disposed about a central mandrel to facilitate uniform compression of the wall 12 without buckling. Further, the mandrel could be heated to facilitate heat-setting the wall 12 while in its fully or partially compressed state.

During assembly of the sleeve 10 about an elongate member 26 to be bundled and protected, such as a wire harness, conduit, or otherwise, the wall 12 can be axially compressed along its central axis 14 to a fully or partially compressed first state (FIG. 1A), wherein the wall 12 remains in, or substantially in the first state absent some externally applied forced sufficient to move the wall 12 to a different configuration. If the wall 12 is relatively long, such as about 2 ft or longer, separate lengthwise extending regions can be axially compressed until the entire wall 12 is axially compressed at least in part, thereby making it easy to transform the entire length of the wall 12 to the first, axially compressed state. As such, the sleeve 10 takes on an increased diameter D1 and/or increased cross-sectional area, which allows the wall 12 to be more easily and readily disposed over the elongate member 26 to be protected, as well as over and about any enlarged connectors or fittings (not shown) that may be present along the length of the elongate member 26. Then, upon disposing the elongate member 26 through the radially expanded wall 12, an axially applied tensile force can be applied to the wall 12, such as by pulling at least one of the opposite ends 16, 18 axially away from the other of the opposite ends 16, 18, thereby causing the wall 12 to extend axially and snap or transform from the radially expanded, reduced length first state to the radially contracted, increased length second state, such as shown schematically in FIG. 1B, by way of example and without limitation. It should be recognized that any portion or portions of the wall 12 can be lengthened from the reduced length state L1, as desired, while leaving the remaining portion or portions in the first, axially compressed, radially expanded state if desired. As such, the wall 12, which can be knit to extend over any desired axial length, can be extended axially over the desired length of the elongate member 26 to be protected. With the wall 12, or at least portion thereof, being moved to the increased length L2, reduced diameter D2 and/or reduced cross-sectional area second state, the wall 12 is able to contain the elongate member 26, such as a wire harness, for example, in the desired envelop to allow the elongate member 26 to be neatly bundled and routed, as desired. As mentioned above, in addition to the knit wall 12 acting to bundle the elongate member 26, particularly in the case of a wire harness having a plurality of individual, exposed wires, the knit wall 12 can act to provide protection to the elongate member 26 against abrasion, against the ingress of contamination, and further provide acoustic/dampening and/or thermal protection.

Many modifications and variations of the present invention are possible in light of the above teachings. In addition, it is to be recognized that a knit tubular wall constructed in accordance with the various aspects of the invention can take on a multitude of uses, including that of a protective member and/or a bundling member, by way of example and without limitation. It is contemplated that all features of all claims and of all embodiments can be combined with each other, so long as such combinations would not contradict one another. It is, therefore, to be understood that the invention may be practiced otherwise than as specifically described, and that the scope of the invention is defined by any ultimately allowed claims.

What is claimed is:

1. A protective textile sleeve, comprising:

a knit, tubular wall extending lengthwise along a central longitudinal axis between opposite ends;

said wall having a first state with a decreased length, increased cross-sectional area, as viewed in cross-section taken generally transversely to said central longitudinal axis, and a second state with an increased length, decreased cross-sectional area, as viewed in cross-section taken generally transversely to said central longitudinal axis, and further including knit, heat-set yarns imparting a bias on said wall, said bias causing said wall to remain substantially in said first and second states absent some externally applied force.

2. The protective sleeve of claim 1, wherein said wall includes both heat-set yarns and non-heat-set yarns.

3. The protective sleeve of claim 2, wherein said wall includes warp knit stitches.

4. The protective sleeve of claim 1, wherein said wall is fabricated entirely of heat-set yarns.

5. The protective sleeve of claim 1, wherein said wall includes warp knit stitches.

6. The protective sleeve of claim 1, wherein said wall has single course lapped stitches.

7. The protective sleeve of claim 6, wherein said wall has rhombus-shaped openings.

8. The protective sleeve of claim 1, wherein said wall has multiple course lapped stitches.

9. The protective sleeve of claim 8, wherein said wall has hexagonal-shaped openings.

10. The protective sleeve of claim 8, wherein said wall has honeycomb-shaped openings.

11. The protective sleeve of claim 1, wherein said wall has pillar knit stitches.

12. A method of constructing a textile sleeve, comprising:

knitting a plurality of yarns with one another to form a seamless tubular wall extending lengthwise along a central longitudinal axis with at least some of said yarns being provided as heat-settable yarns, said tubular wall being moveable between a decreased length, increased cross-sectional area first state and an increased length, decreased cross-sectional area second state; and heat-setting said heat-settable yarns while said wall is in one of said first state and second state to impart a bias on said wall via said heat-set yarns, said bias causing said wall to remain in each of said first and second states absent an externally applied axial force causing said wall to be moved to the other of said first or second state.

13. The method of claim 12, further including knitting the wall with a plurality of heat-settable yarns and a plurality of non-heat-settable yarns.

14. The method of claim 12, further including knitting the wall entirely with heat-settable yarns.

15. The method of claim 12, further including knitting said wall in a warp knitting process.

16. The method of claim 12, further including knitting the wall having rhombus-shaped openings.

17. The method of claim 12, further including knitting the wall having hexagonal-shaped openings.

18. The method of claim 12, further including knitting the wall having honeycomb-shaped openings.

* * * * *